United States Patent [19]

Capolupo

[11] 4,414,719

[45] Nov. 15, 1983

[54] WRISTWATCH ATTACHMENT WITH INTERCHANGEABLE END PIECES

[75] Inventor: David F. Capolupo, Oakville, Conn.

[73] Assignee: Timex Corporation, Waterbury, Conn.

[21] Appl. No.: 360,142

[22] Filed: Mar. 22, 1982

[51] Int. Cl.[3] ..... A44C 5/14

[52] U.S. Cl. ..... 24/265 WS; 24/265 B; 24/615; 24/616; 224/168; 224/164

[58] Field of Search ..... 24/265 WS, 265 B, 230 R, 24/230 AK, 230 AL; 224/164–180; D10/32; D11/3

[56] References Cited

U.S. PATENT DOCUMENTS

| | | | |
|---|---|---|---|
| 1,238,495 | 8/1917 | Christ | 24/230 R |
| 1,809,277 | 6/1931 | Kestenman | 24/265 B |
| 3,251,110 | 5/1966 | Hedu | 24/230 R |
| 4,231,502 | 11/1980 | Meyerson | 224/177 |

FOREIGN PATENT DOCUMENTS

| | | | |
|---|---|---|---|
| 1025863 | 10/1950 | France | 24/265 WS |
| 570168 | 12/1957 | Italy | 24/265 WS |

*Primary Examiner*—Gene Mancene
*Assistant Examiner*—John Weiss
*Attorney, Agent, or Firm*—William C. Crutcher

[57] ABSTRACT

An interchangeable end piece member for removably connecting a watchband to a wristwatch case so as to accommodate watchbands universally to watchcasings having various spacings and configurations between the lugs for spring bars of different lengths. The end piece member has at least one tongue which slides into a mating longitudinal groove in a retainer clip attached to the watchband. A resilient tab locks the tongue in the groove, with means to release the tongue by deflecting the tab.

2 Claims, 5 Drawing Figures

WRISTWATCH ATTACHMENT WITH INTERCHANGEABLE END PIECES

BACKGROUND OF THE INVENTION

Figure 1:
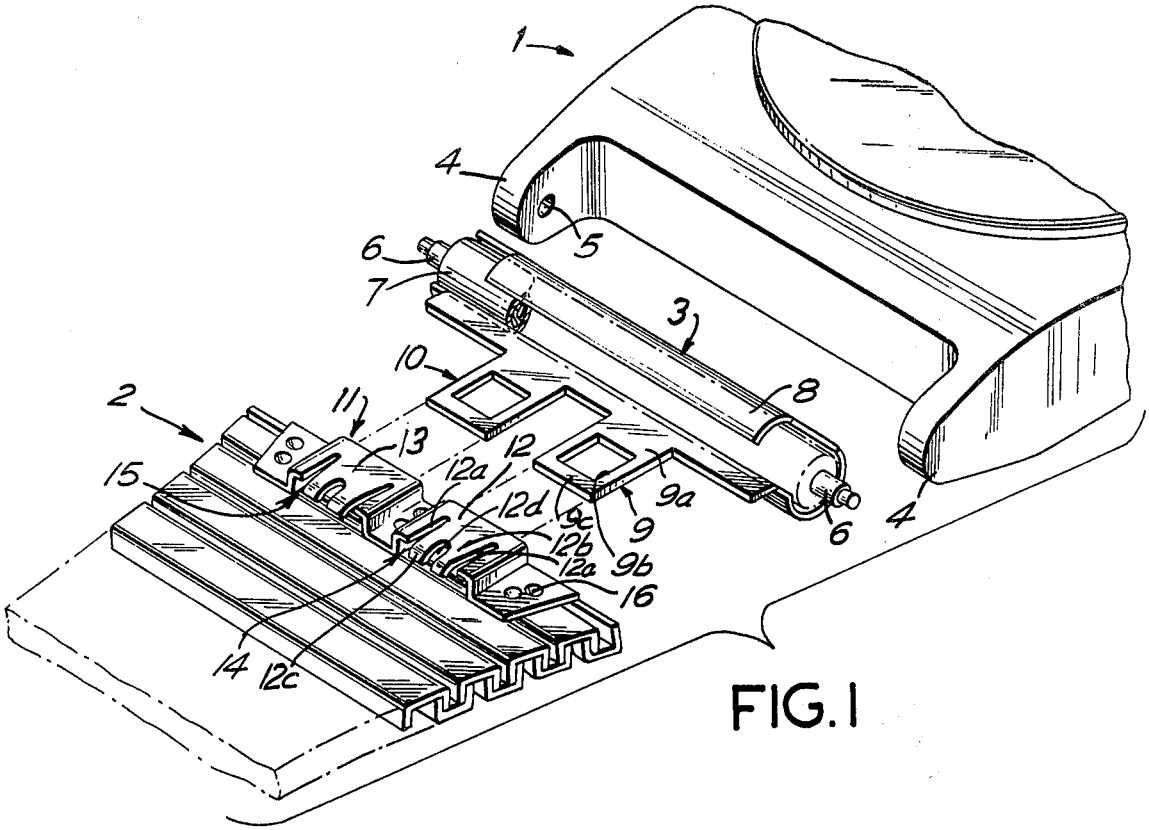

This invention relates generally to means for attaching watchbands to wristwatches, and more particularly to an interchangeable end piece serving as an intermediary member between the watchband and the watchcase.

Various special types of attachments have been proposed to connect a watchband to a wristwatch case so that the user can easily remove the band. Exemplary of such arrangements is the following list of patents which, is by no means inclusive, but serves to illustrate the state of the art.

| PATENT Number | INVENTOR | ISSUE DATE |
|---|---|---|
| 1,382,256 | Tomchin | June 21, 1921 |
| 2,629,981 | Melik-Minassiantz | March 3, 1953 |
| 3,165,884 | Gwinner et al | January 19, 1965 |
| 4,217,681 | Grohoski et al | Aufust 19, 1980 |

The foregoing constructions require special shapes or connectors on the watch case, in contrast to the conventional connection means, which comprises two spaced lugs or horns on the watch case with opposed holes to receive a "spring bar" with spring loaded pintels which snap into the holes. However there are various spacings and configurations between the lugs and, although these are more or less standardized in the industry, nevertheless large inventories of watchbands of different widths must be carried in order to accommodate the different lug spacings.

Constructions are known in the art which employ an intermediate member between the watchband and the watchcase which has a tubular section on one side to receive a conventional spring bar and which has means on the other side to connect to a watchband.

U.S. Pat. No. 3,889,923 issued June 17, 1975 to Reith discloses such an intermediate member, having a plate attached to the end of the watchband by a hinged clasp connection designed to be operated by the user for changing watchbands. The intermediate member has a variable length tubular section to accommodate variable lug spacings.

French Pat. No. 1,025,863 to Chatenoud, filed Oct. 12, 1950, has an intermediate member with a fixed length tubular member on one side and a tongue adapted to slide into and be retained within the interior of a spring coil watchband.

U.S. Pat. No. 4,234,115 issued to Williams on Nov. 18, 1980 includes an intermediate member with a tongue adapted to slide between spring-biased release buttons.

While the foregoing constructions might be suitable for their particular applications, it is desired to have an improved low cost means for attaching an intermediate end piece between the watchcase and the watchband and which is very low cost so that the intermediate members can be provided in various lengths to accommodate different lug spacings on the one hand, while adapted to be easily attached to a universal and uniform connection on the watchband on the other hand.

Accordingly, one object of the present invention is to provide an improved interchangeable end piece for connecting a watchband to a watchcase using conventional spring bars.

Another object of the invention is to provide an improved releasable connector between an end piece and a watchband.

DRAWINGS

Figure 2:
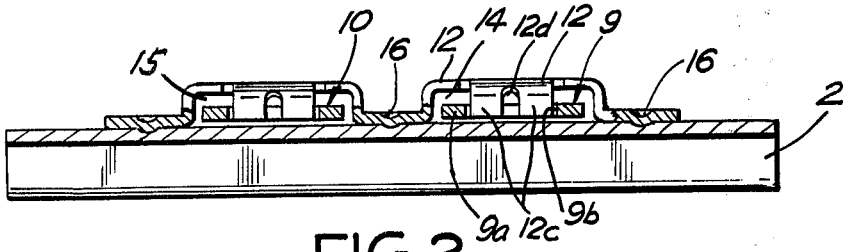
Figure 3:
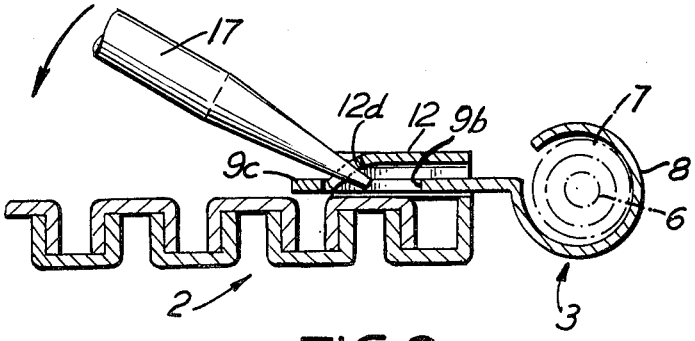
Figure 4:
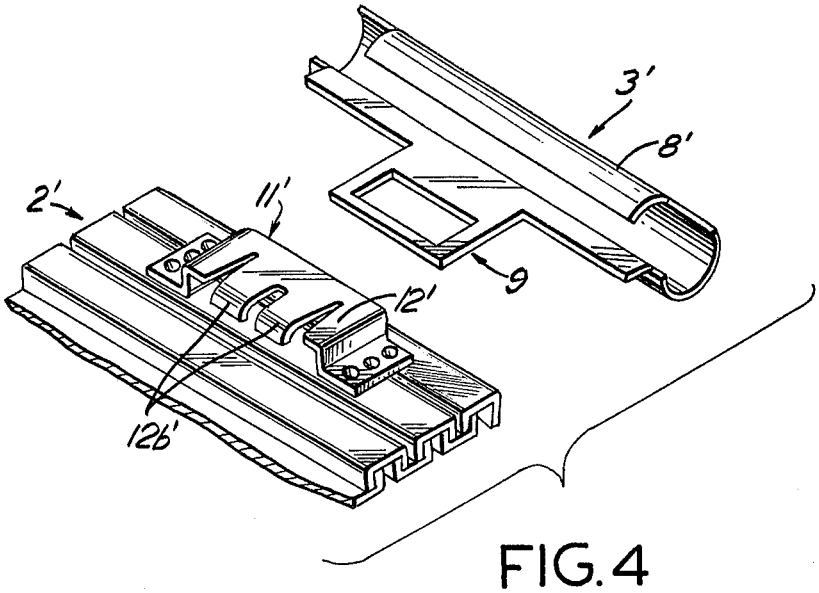
Figure 5:
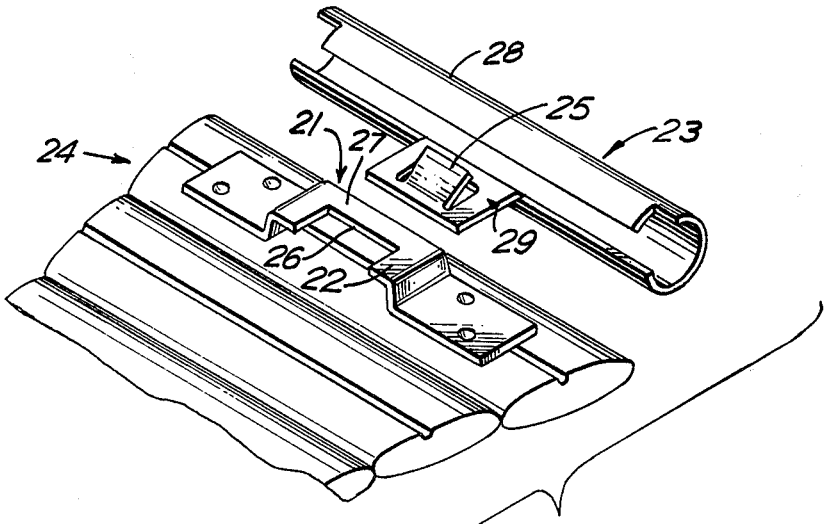

The invention, both as to organization and method of practice, together with further objects and advantages thereof, will best be understood by reference to the following description, taken in connection with accompanying drawings, in which:

FIG. 1 is a perspective view of portions of the watchband and watchcase, illustrating the construction of the end piece and inverted, i.e., seen from the underside of the watch, FIG. 2 is an elevation drawing, cross section and inverted, taken transversely through the watchband, FIG. 3 is an elevation drawing, in cross section and inverted, taken longitudinally, through the watchband and end piece, FIG. 4 is a perspective view of a modified form of the invention, and FIG. 5 is a perspective view of yet another modification of the invention.

SUMMARY OF THE INVENTION

Briefly stated, the invention comprises an improvement in an attachment between a watchband and a wristwatch case employing an intermediate member with a tubular section adapted to accommodate a conventional spring bar connection to the watchcase, said improvement comprising a retainer clip attached to the watchband defining at least one longitudinal passage, the passage being formed in part by a first plate portion spaced from the watchband, the intermediate end piece member having at least one longitudinal tongue adapted to slide into said passage having a second plate portion enclosed between the first plate portion and the watchband, at least one of said plate portions having a resilient tab thereon biased toward the other plate portion, and the other plate portion defining a notched-out area adapted to receive said tab when the tongue is inserted into the passage and said other plate portion also having a transverse section inteferring with removal of the tongue due to spring action of the tab.

Referring now to FIG. 1 of the drawing, portions of a watchcase 1 and a watchband 2 viewed from the underside are seen to be connected by means of an intermediate end piece shown generally at 3. A watchcase 1 includes conventional lugs 4 with opposed holes such as 5 adapted to receive the pintels 6 of a conventional spring bar 7.

End piece 3 includes a tubular section 8 and a pair of extending flat tongues 9, 10. The tubular section 8 and tongues 9, 10 may conveniently and economically formed out of a single thickness of metal such as stainless steel, although it is within the scope of the present invention to incorporate an extra piece or cover with the end piece to fit special configurations.

The present invention contemplates that end pieces having tubular sections 8 of varying lengths will be employed which, however, comtemplate a common or universal shape of tongues 9, 10. Each of the tongues incorporates a substantially flat plate portion such as **9*a*, a notched-out area such as 9*b* in the plate portion, and a transverse section such as 9*c***.

A complementary retainer clip 11 is attached to the watchband 2 to receive and retain tongues 9, 10. Retainer clip 11 is formed from a single piece to include a pair of first plate portions 12, 13 which are spaced above the watchband to provide longitudinal passages 14, 15 respectively. Each of the retainer clip plate portions, such as 12, includes notches such as 12*a* to provide a tab 12*b*. Tab 12*b* is formed at the ends with fingers 12*c* extending toward the watchband separated by an access notch 12*d*. The retainer clip 11 is manufactured of relatively hard material which is resilient so as to provide a spring action forcing tabs 12*b* toward the watchband. The retainer clip is attached to the watchband by suitable means such spot welds indicated at reference number 16.

Referring to FIG. 2 of the drawing, the transverse cross section illustrates the connection after tongues 9, 10 have been slid into the longitudinal passages 14, 15. Tongues 9, 10 comprise a second pair of flat plate portions. The resilient tab 12*b*, which is biased toward the tongue is shown snapped into the notched out area 9*b*.

Referring to the longitudinal cross section of FIG. 3 of the drawing, it is seen that the transverse section 9*c* on tongue 9 prevents the withdrawal of tongue 9 from the longitudinal passage because of interference with the fingers 12*d* on resilient tabs formed in plate portion 12. In order to remove the watchband 2 from the end piece 3, a pointed tool such as 17 is employed to raise the tab and allow tongue 9 to be withdrawn.

Referring to FIG. 4 of the drawing, a modified form of the invention is shown. In this case, the same reference numbers are employed with prime superscripts to designate like elements. An end piece 3' employs a single tongue 9' extending from a tubular section 8'. A retainer clip 11' on the watchband 2' employs only a single plate portion 12' with resilient tab 12*b*'. In all respects, the modification of FIG. 4 functions as previously described in connection with FIGS. 1–3, except that only a single tongue and groove connection is employed for narrow watchbands.

Another modification of the invention using a single tongue is seen in FIG. 5. A double tongue connection could easily be substituted, as should be apparent from the previous description. Referring to FIG. 5, an end piece 23 is adapted for connection to a watchband 22. End piece 23 includes a tubular section 28 and a tongue 29. Attached to the watchband 24 is a retainer clip 21 formed to include a first plate portion 22 spaced from the watchband as before to define a longitudinal passage for accommodating a second flat plate portion on tongue 29. In the case of FIG. 5, however, the resilient tab and the cutout section are reversed. A resilient tab 25 is formed in tongue 29 and biased toward the first plate portion 22 on the retainer clip. A cutout area 26 is arranged to receive the tab and a transverse section 27 prevents withdrawal of the tongue due to interference with the tab after the tongue has been inserted.

OPERATION

The operation of the invention should be apparent. Retainer clips are attached to watchbands of varying shapes and sizes beforehand, and a stock of intermediate end pieces is maintained to accommodate variable spacings between lugs of the watchcases. In order to accommodate a watchband to a particular case, it is only necessary to insert the proper length intermediate end piece which snaps into place and adapts the watchband to fit that particular type case. In the event that it is desired to adapt the watchband to a different case lug spacing, it is only necessary to remove the end piece using a tool as illustrated in FIG. 3 and to replace with an end piece of the proper length.

The simplicity of the attachment means and the economical construction of the replaceable end piece allows a greater variety of styles and case sizes and types of watchbands to be utilized. This results in cost savings to the manufacturer to avoid obsolete bands and improved products to the customer due to shorter manufacturing cycles and greater variety of product.

While there has been described what is considered at present to be the preferred form of the invention, other modifications will occur to those skilled in the art and it is desired to secure in the appended claims all such modifications as fall within the true spirit and scope of the invention.

I claim:

1. An improved intermediate end piece for connecting a watchband to a watchcase having spaced lugs adapted to accommodate a conventional spring bar, said improvement comprising:

a retainer clip attached to the watchband having a first plate portion spaced from the watchband and defining at least one longitudinal passage therebetween, an end piece member having a tubular section adapted to receive the spring bar and also having at least one longitudinal tongue adapted to slide into said passage, said tongue including a second plate portion enclosed between the first plate portion and the watchband;

at least one of said plate portions having an integral resilient tab defined therein biased toward the other plate portion, said resilient tab including a notch in the end thereof in order to facilitate entry of a tool for springing the tab to release the end piece, and said other plate portion defining a notched out area arranged to receive said tab when said tongue is inserted in the passage and defining a transverse section preventing easy removal of the tongue due to interference with the tab.

2. An improved end piece for connecting a watch band to a watchcase having spaced lugs thereon adapted to receive a conventional spring bar, the improvement comprising:

a retainer clip attached to the watchband and defining a pair of longitudinal passages formed in part by a pair of first plate portions spaced from the watchband, an end piece member formed from a single sheet of uniform thickness and having a tubular section adapted to receive said spring bar and a pair of spaced flat tongue members adapted to slide into said passages, each of said retainer clip plate portions having an integral resilient tab defined therein biased toward the respective tongues, and each of said tongues defining a hole therein adapted to receive said resilient tabs, whereby the tabs prevent easy removal of the end piece from the watchband, each of said resilient tabs further defining means to facilitate entry of a tool for springing the tabs to release the end piece from the watchband.

* * * * *